United States Patent [19]

Poulin et al.

[11] Patent Number: 4,784,611

[45] Date of Patent: Nov. 15, 1988

[54] LOCKING PLUG

[76] Inventors: Fernand H. Poulin, 423 McDonald St., Granby, Canada, J2G 6Z3; Denis Oakes, 34 du Plateau, Ste-Julie, Canada, J0L 2S0

[21] Appl. No.: 86,605

[22] Filed: Aug. 18, 1987

[51] Int. Cl.[4] ..... H01R 13/639

[52] U.S. Cl. ..... 439/346

[58] Field of Search ..... 439/266, 268–270, 439/346, 369, 372, 373

[56] References Cited

U.S. PATENT DOCUMENTS

| | | | |
|---|---|---|---|
| 1,404,098 | 1/1922 | Dennis | 339/74 |
| 1,720,463 | 7/1929 | Both | 339/74 |
| 1,941,374 | 12/1933 | Weisberg | 173/361 |
| 2,002,558 | 5/1935 | Von Holtz | 173/328 |
| 2,096,382 | 10/1937 | Ronka | 439/268 |
| 2,199,599 | 5/1940 | Stambaugh | 439/268 |
| 2,266,130 | 12/1941 | Theriault | 173/332 |
| 2,636,096 | 4/1953 | Di Blasi | 200/115.5 |
| 2,704,831 | 3/1955 | Smith | 439/346 |
| 3,489,989 | 1/1970 | Robaczewski | 439/346 |
| 3,710,304 | 1/1973 | Warner et al. | 339/74 |
| 3,828,300 | 8/1974 | Codrino | 439/346 |
| 3,890,030 | 6/1975 | McDaniel | 339/113 L |
| 3,919,471 | 11/1975 | Spiessbach et al. | 178/7.1 |
| 4,085,991 | 4/1978 | Marshall et al. | 439/346 |
| 4,111,516 | 9/1978 | Wireman | 339/113 |
| 4,118,690 | 10/1978 | Paynton | 340/656 |
| 4,136,919 | 1/1979 | Howard et al. | 439/346 |
| 4,205,376 | 5/1980 | Yoshida | 364/424 |
| 4,298,190 | 11/1981 | MacKay | 266/156 |
| 4,484,185 | 11/1984 | Graves | 340/656 |
| 4,586,770 | 5/1986 | Poulin | 439/270 |

FOREIGN PATENT DOCUMENTS

| | | |
|---|---|---|
| 846786 | 7/1970 | Canada . |
| 882349 | 9/1971 | Canada . |
| 932057 | 8/1973 | Canada . |
| 1211179 | 9/1986 | Canada . |
| 780162 | 1/1935 | France . |

*Primary Examiner*—J. Patrick McQuade

[57] ABSTRACT

An electrical receptacle consisting of a casing having a lock part to releasably lock a mating electrical plug of the blade contact type, is disclosed. The lock part is a separate piece made of electric insulating material and manually-operable release buttons externally of the casing. The lock part ensures an effective locking of the plug and eliminates any possibility of electric shock to a user while inserting or removing the plug contacts.

8 Claims, 4 Drawing Sheets

LOCKING PLUG

FIELD OF THE INVENTION

The present invention relates to electrical receptacles, more specifically to a receptacle having novel lock means for retaining a conventional mating plug.

BACKGROUND OF THE INVENTION

It is known in the art to provide an electrical receptacle having means to lock a male plug when there is electrical continuity between receptacle and plug. The purpose of such receptacles is to render safe their use and to avoid the inconvenience of accidental disconnection of a plug from the receptacle when using, for example, power tools which are carried about a workshop. The alternative is to tie a knot at the connection.

The U.S. Pat. No. 4,586,770, issued to Poulin on May 6, 1986, discloses such a receptacle. However, a potentially dangerous characteristic of this patent is that the fingers or arms (see FIGS. 2 and 5), which are manually displaceable to release the male plug, are electrically energized. The insulating coverts to prevent electric shock to a user may easily fall off with use.

OBJECTS OF THE INVENTION

In view of the above, it is the principal object of the present invention to provide an electrical receptacle which eliminates any hazard of electric shock when used, even by children.

It is another object of the present invention to provide an electrical receptacle of the above type, which may be used with any conventional mating plug and which is simple in design.

SUMMARY OF THE INVENTION

The above and other objects and advantages of the present invention are best realized according to two preferred embodiments.

According to a first embodiment of the receptacle, a generally cylindrical casing is provided, having an end face and an interior cavity. The end face is made with at least a pair of spaced apertures, which communicate with the interior cavity. Preferably, a third aperture is further provided in the end face to accommodate a ground contact. The opposite end of the casing has electric cord-retaining means for an electric cord passing therethrough, so as to connect its two wires (or preferably three, including the ground wire), each to an electrically-conductive bendable strip extending longitudinally of the casing. Each strip is adapted to frictionally conductively engage the contacts of a blade-type electric plug.

Disposed centrally in the cavity between the two strips is a first lock element of the invention. The lock is independent of the strips and is made of resilient electrically, non-conductive material. The lock element includes a pair of walls, each spaced inwardly of the proximate bendable strip and joined together by a transverse base portion. Each wall is formed with a clock means for releasably engaging the conventional opening, made in each blade contact of a plug, the opening being located adjacent the extremity of each blade contact. Release means are attached to both walls and extend transversely diametrically of the casing. The free ends of the release means project exteriorly of the casing, thereby defining a pair of operable knobs.

According to a second preferred embodiment, there is envisioned a duplex receptacle. The latter has a rectangular casing having an inner cavity. The front face of the casing is made with two pairs of spaced slit apertures communicating with the cavity. As in the first embodiment, provision is preferably made for mating plugs having a ground contact. Connection means are provided to electrically connect the four main wires entering the receptacle in pairs on each side, as is known. The wires are in turn electrically connected to electrically-conductive friction members analogous to the strips of the first embodiment.

A lock element for this embodiment consists of two pairs of walls, each generally identical in shape and material to those of the first embodiment. The pairs, one for each set of slits, are disposed in the lengthwise cavity and are provided with lock means, as described above.

Second externally-operable release means are further provided, but are forwardly oriented and terminate on each side of the casing in manually-operable tabs, as will be described more fully below.

Preferably, both embodiments include visual means to indicate electrical continuity between the receptacle and a power source.

BRIEF DESCRIPTION OF THE DRAWINGS

The foregoing will be more clearly understood by having referral to the preferred embodiments of the invention, illustrated by way of the accompanying drawings, in which.

Like numerals indicate like elements throughout the drawings.

DETAILED DESCRIPTION OF THE PREFERRED EMBODIMENTS

Figure 1:
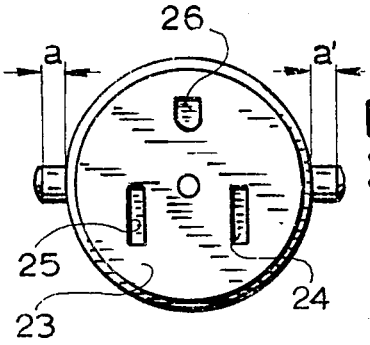
FIG. 1 is an end view of a receptacle according to a first embodiment of the invention.
Figure 2:
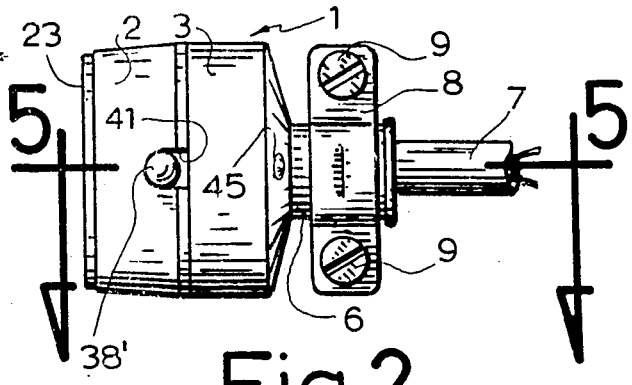
FIG. 2 is a top plan view of the receptacle of FIG. 1.

Referring to FIGS. 1 to 9 inclusively, there is shown a first embodiment of a receptacle indicated at 1. Receptacle 1 consists of a casing including a first cylindrical segment 2 and a second cylindrical segment 3. Segments 2 and 3 are detachably secured together by three screws 4, seen in FIGS. 6 and 7. When assembled together, the two segments form an interior cavity 5. Both segments 2 and 3 are made of a suitable non-conductive plastic.

Second segment 3 has a neck portion 6 through which passes an electrical cord 7. A retaining means for cord 7 is embodied by a squeeze clamp 8, including two tightening screws 9.

Electrical cord 7 carries two main wires 10, 11, and, preferably, a ground wire 12. Wires 10, 11, 12 are each electrically connected to flat plates 13, 14, 15, respectively, which are each held in place on the bottom surfaces 5' of cavity 5 by small screws 16. The electrical connection is made for the three wires 10, 11, and 12 by large standard screws 17, as is known.

Each flat plate 13, 14, and 15 is integrally formed with a longitudinally-extending bendable strip 18, 19, and 20, respectively. Strips 18, 19 are parallel to each other, while strip 20 is oriented orthogonally to strips 18 and 19. As shown clearly in FIG. 5, strips 18, 19 are slightly inwardly inclined for a major portion of their lengths and each has an outwardly-bent free end 21, 22, respectively. (strip 20 is shown only in cross-section in FIG. 6).

First segment 2 has an end face 23, as seen in Figure 1. Face 23 has a pair of spaced apertures 24, 25 and a third aperture 26 for the ground connection of a plug 27. All three apertures communicate with channels 24', 25' formed in interior cavity 5, such channels receiving the contacts of plug 27.

Plug 27 is of the blade type, having blade contacts 28 and a ground contact 29 connected to an electrical cord 30. Cord 30 may be secured to the plug by a bracket 31 or any other suitable element.

Referring now to FIG. 5 and FIGS. 7 to 9, there is shown an embodiment of a lock element 40. The latter consists of a pair of parallel, generally square, resiliently deformable and electrically non-conducting wall members 34, 35 integrally joined along two mutually-opposite edges by a transverse flat portion 32. The outer surface of portion 32 is provided with an anchoring stud 33 integrally formed therewith.

Both walls 34, 35 are formed at one of the corners remote from portion 32, with a protuberance 36, 37, generally circular in cross-section, and protruding from the outer surfaces of the walls. The others corners of the walls 34, 35 remote from portion 32 have, projecting transversely from their respective outer surface, elongated arm members 38, 39.

Figure 5:
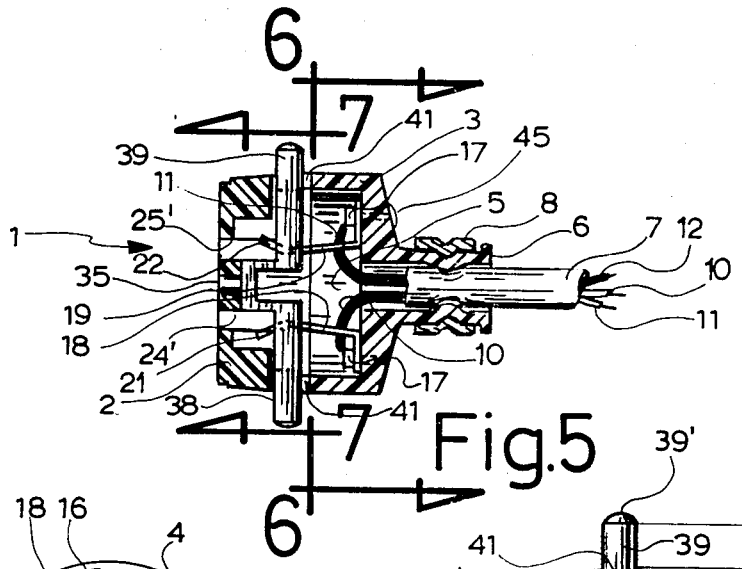
FIG. 5 is a sectional view taken along lines 5—5 of FIG. 2.
Figure 6:
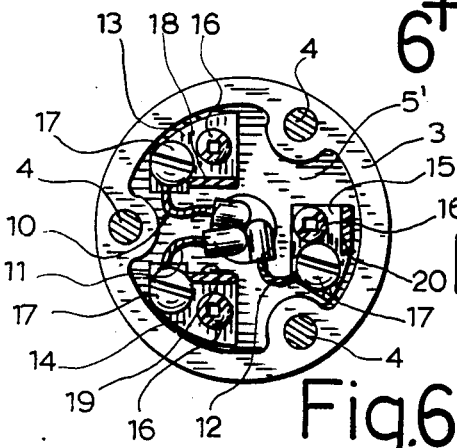
FIGS. 6 and 7 are sectional views taken along lines 6—6 and 7—7, respectively, of FIG. 5.
Figure 7:
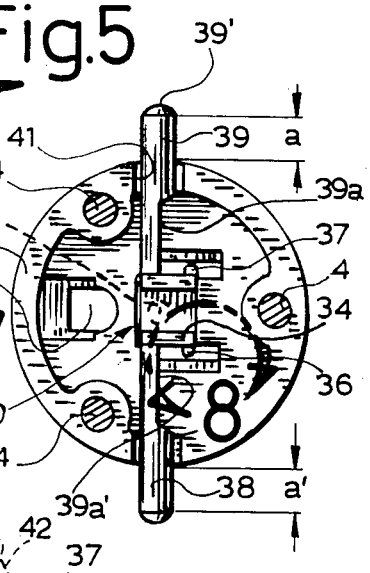

The lock element 40 is disposed in interior cavity 5, so that anchoring stud 33 engages a central axial hole made in first segment 2. Portion 32 is of a width sufficient to locate walls 34, 35, immediately inwardly of the two aperture channels 24', 25' with stud 33 projecting towards end face 23, as shown in FIG. 5. FIG. 7 shows protuberances 36, 37 projecting into their respective channels 24', 25' in the middle thereof. Elongated arm members 38 and 39 extend transversely or diametrically of the casing, having their outer ends located exteriorly of the casing. U-shape openings 41 are provided in segment 2 at diametrically-opposed locations, in order to receive the end portions of arms 38, 39. These end portions thus define externally-operable knobs 38' and 39'. Arms 38, 39 are recessed at their inner end portion (see recess 39*a*, 39*a*', FIG. 7) to clear the blade 28 inserted in channels 24', 25'.

It will be clear that the lock means and the release means referred to above are embodied by protuberances 36, 37 and by the elongated arms 38 and 39, respectively.

Figure 9:
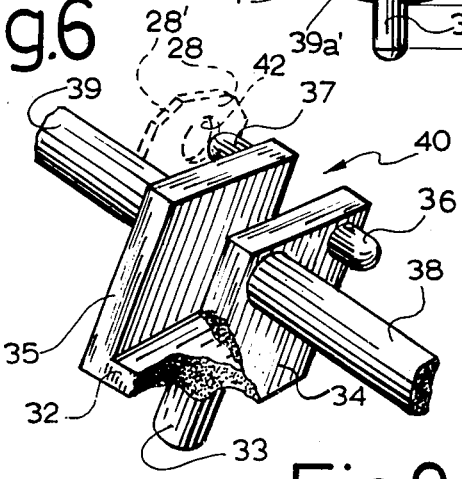
FIG. 9 is a perspective view, partly broken away, of a first embodiment of a lock element contemplated by the invention.

FIG. 9 illustrates in dashed outline a portion of one blade contact 28 of a male plug 27. Contact 28 has an opening 42 only slightly larger in diameter than that of the protuberances 36,37 and is lockingly engageable by one of the latter.

Figure 8:
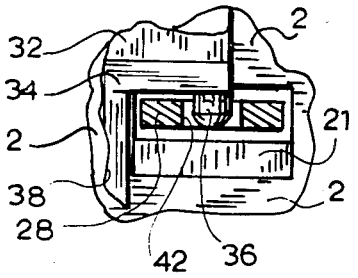
FIG. 8 is an enlarged plan view taken within circular line 8 of FIG. 7 and showing in cross-section a plug blade in locked position.

FIG. 8 illustrates such a blade contact 28 fully locked by one of the protuberances 36, 37 extending through opening 42.

There is no lock for ground contact 29.

Figure 3:
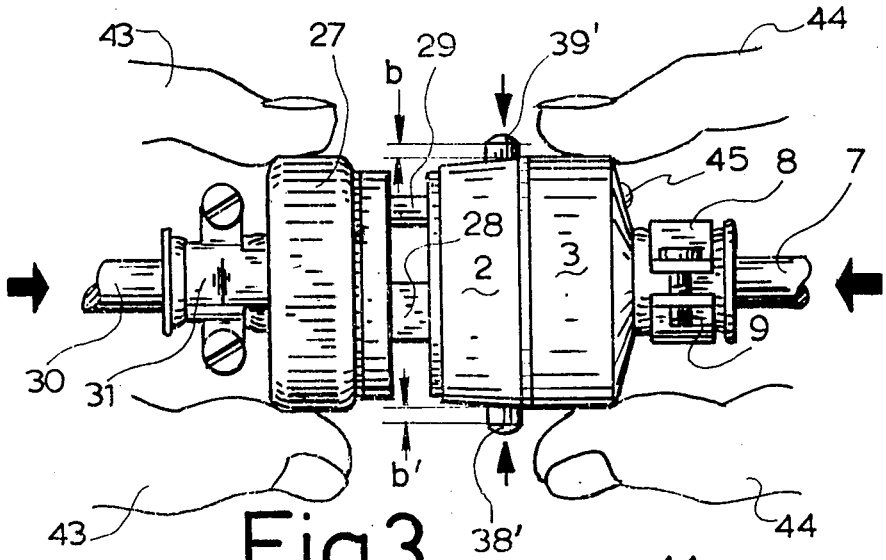
FIGS. 3 and 4 are side elevations of the receptacle of FIG. 1 showing how a mating plug is plugged into and retracted from the receptacle, respectively.
Figure 4:
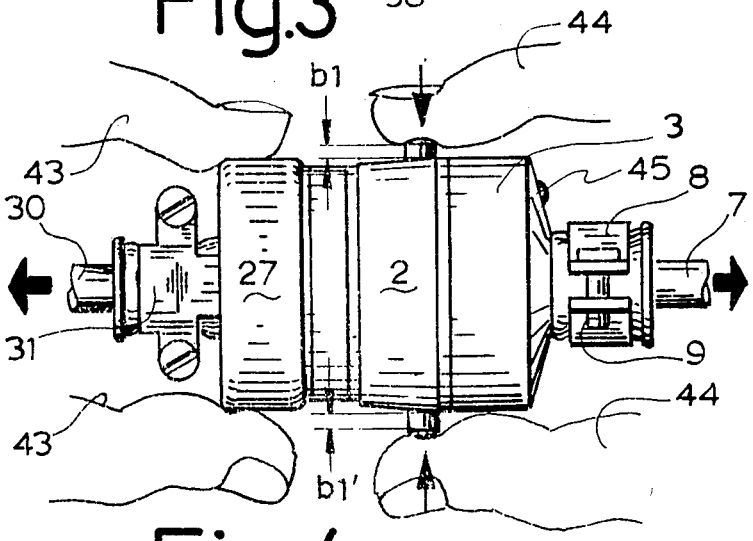

It will be easily understood that, in order to connect plug 27 with the receptacle of the invention, the former needs only to be pushed with fingers 43 into the receptacle held by fingers 44, as seen in FIG. 3. The full stroke of knobs 38', 39' is indicated by a, a' in FIG. 1. Protuberances 36, 37 ride on blades 28 and automatically engage openings 42 when plug 27 is fully inserted. This is due to the resiliency of lock 40. FIG. 3 shows that the protuberances 36, 37 are riding blades 29, as indicated by the depressed condition of knobs 38' 39' (compare b, b' with a, a'). Upon insertion of protuberances 36, 37 into blade openings 42, knobs 38' 39' return to their fully-extended position of FIG. 1.

In order to disengage plug 27 from the receptacle, knobs 38', 39' are simply depressed by fingers 44, to free blade contacts 28, 29, while fingers 43 of the other hand grasp the plug 27, which is pulled out. Thus, protuberances 36 and 37 will also be pushed inwardly a distance equal to the stroke a, a' of knobs 38', 39'.

To indicate the presence of electric current between the receptacle 1 and a power source, L.E.D. 45 (light-emitting diode) is provided at the rear face of second segment 3 (see FIG. 5) and connected across wires 10, 11.

Referring now to FIGS. 10 to 16 inclusively, there is shown a second embodiments of the invention, specifically a duplex receptacle, indicated generally at 46. Receptacle 46 is adapted for typical installation in a wall 47, including for such purpose, a conventional electrical box 48 secured in wall 47 in any known manner.

Figure 11:
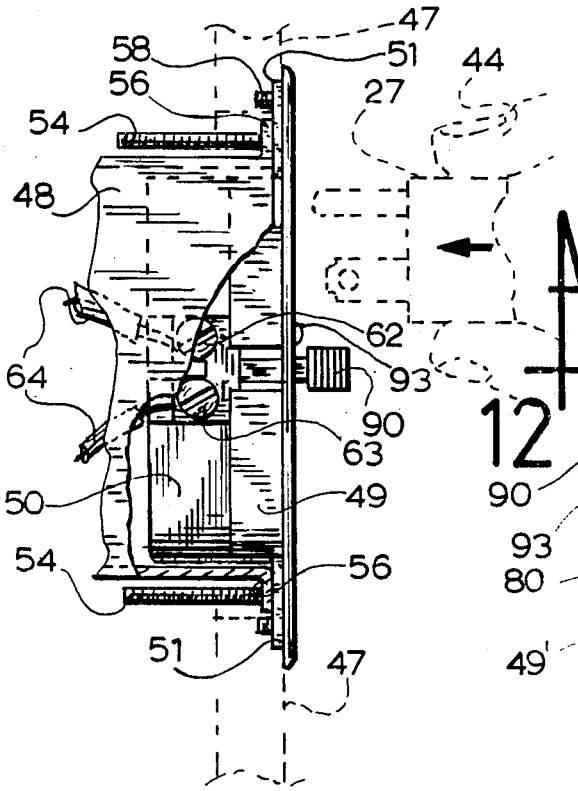
FIG. 11 is a lateral elevation, partly broken away, of the embodiment of FIG. 10 installed in a wall shown in dashed outline.

Receptacle 46 is formed of a front segment 49 and a rear segment 50, the rear segment being fixed to a conventional U-shape shape bracket applied against three sides of segment 50 (FIGS. 12 and 13) and forming attachment ears 51, each having a slot 52 for fastening receptacle 46 to box 48 by long screws 54 extending through the slots 52 of ears 51 and through a flange 56 formed at the contiguous edges of box 48, as shown in FIG. 11. The assembly is completed by a cover plaque 57 secured to threaded holes 61 of ears 51 by short screws 58. Segment 49 has a front face 49'.

Figure 12:
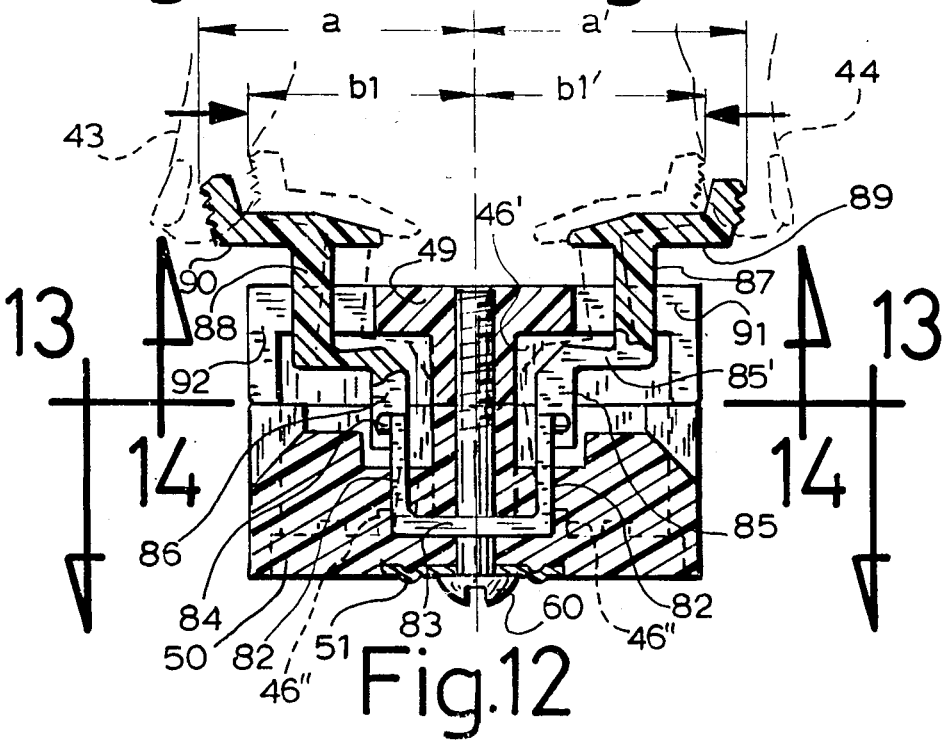
FIG. 12 is a cross sectional view taken along line 12—12 of FIG. 10.
Figure 14:
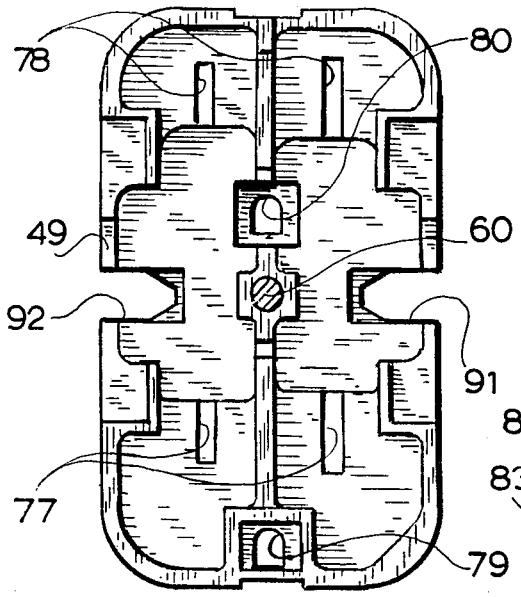
FIGS. 13 and 14 are further sectional views taken along lines 13—13 and 14—14, respectively, of FIG. 12.
Figure 13:
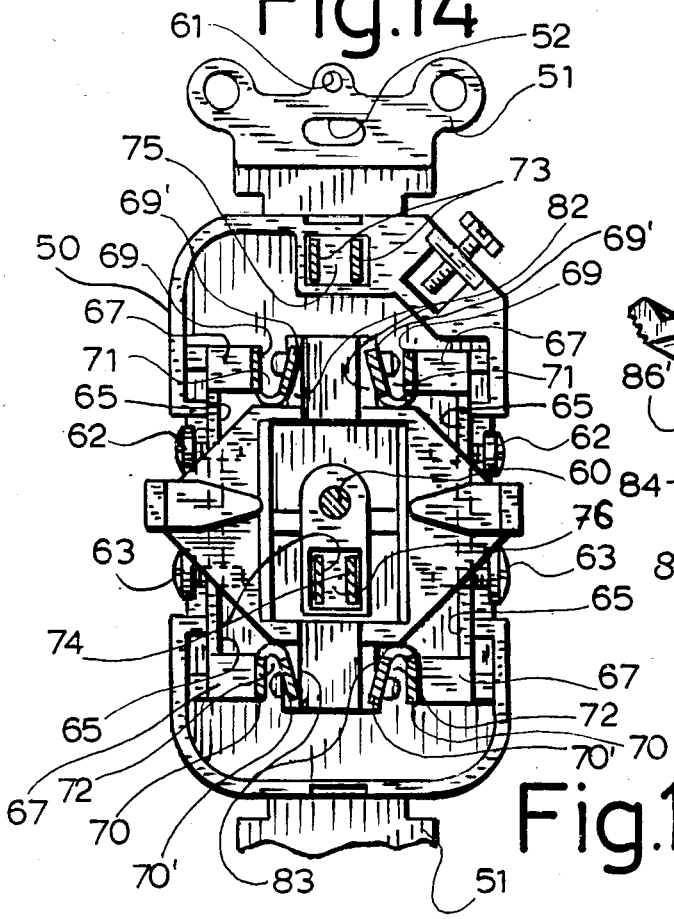

FIGS. 12 and 13 illustrate the structural details of receptacle 46. The two segments 49,50 are detachably held together by a central screw 60 threadedly engaged in front segment 49. Both segments 49,50 are made of rigid plastic and together define a cavity 46'.

Rear segment 50 is provided with a pair of lateral, electric connections means consisting of contact screws 62, 63, which serve to electrically connect one or two wires, on each side of the segment. Only two such wires 64 of like polarity are shown in FIG. 11. Two wires of opposite polarity are connected to a power source.

Contact screws 62, 63 are screwed in a conductive longitudinal member 65 provided at its two ends with a right angle bent portion 67, as clearly seen in FIG. 13. The latter in turn integrally carries forwardly-projecting, resiliently-bendable conductive friction members 69, 70, respectively, each having a generally parallel inner portion 69', 70'. The friction members and their parallel portions define channels 71, 72 for the blade contacts 28 of a mating plug 27.

To accommodate a plug 27 having a ground contact 29, each receptacle of the duplex arrangement is further provided with a pair of forwardly-projecting, spaced resilient strip members 73, 74, respectively, thus defining ground channels 75, 76.

Figure 10:
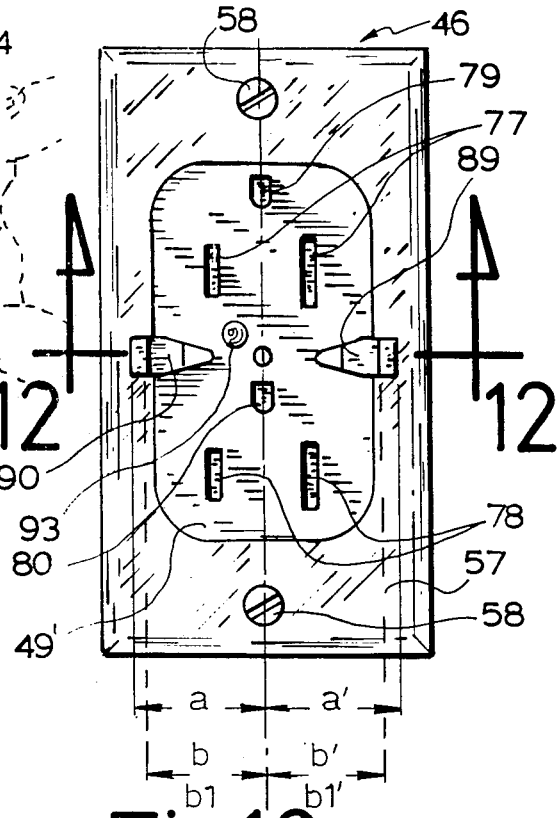
FIG. 10 is a front view of a receptacle according to a second embodiment.

Channels 71, 72 and neutral channels 75, 76 communicate with slit apertures 77, 78 and apertures 79, 80, respectively, provided in face 49' as shown in FIG. 10.

Figure 16:
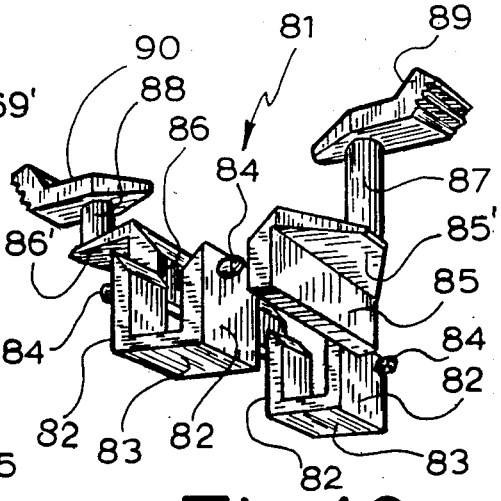
FIG. 16 is a perspective view of the lock element of FIG. 15.

Referring to FIG. 16, there is shown a second lock element 81 according to the invention and which is adapted for the duplex receptacle 46.

Figure 15:
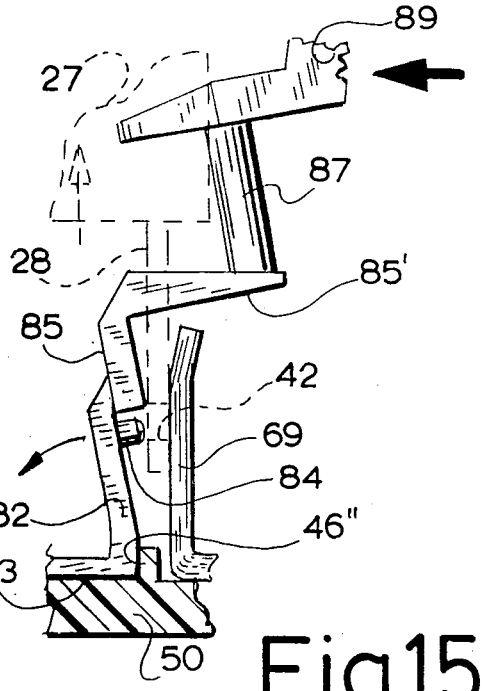
FIG. 15 is an end view of a portion of a second embodiment of a lock element in release position, also showing in dashed outline a portion of a blade type plug.

Lock element 81 comprises two pairs of walls 82, respectively, one such pair being spaced lengthwise from the other pair and the walls of each pair integrally joined by a base web 83, each frictionally fitted between a pair of ribs 46" upstanding from the base of inner cavity 46', as best seen in FIGS. 12 and 15. These walls are substantially identical in shape and are made of the same electric insulating material as wall members 34, 35 of the first lock element 40, but do not include an anchoring stud. The lengthwisely-remote corners of each wall of both pairs are integrally formed with protuberances 84, which project transversely into channels 71 and 72.

The second release means referred to above consists of a pair of inverted L-shape flange members 85 and 86, each integral at the lower corners with the lengthwisely proximate outer surface corner of each aligned pair of walls 82. Flanges 85, 86 have a triangular outwardly-extending forward portion 85', 86' integrally formed with a forwardly-extending arm 87 and 88, respectively. The latter terminate in the transversely-oriented tabs 89, 90, respectively.

Arms 87, 88 extend through lateral openings 91, 92 formed in front segment 49.

FIGS. 12 and 15 depict how a plug or plugs 27 may be released from one or both pairs of slit apertures 77, 78 of duplex receptacle 46, In non-bent position, the distance between the two tabs 89, 90 is a+a'. Pressing the two tabs towards each other with fingers 43, 44, so that the interval becomes b1 +b1' will bend walls 82, 82 inwardly, thereby pushing protuberances 84 out of openings 42 of blade contacts 28. To insert a plug 27, it is simply pushed in and the protuberances 84 automatically engage the blade openings 42.

Preferably, duplex receptacle 46 is also provided with n L.E.D. 93 to indicate electrical continuity between the receptacle and the power source.

What I claim is:

1. An electrical receptacle for use with a conventional electrical plug having blade-type contacts with an opening at their outer portions, comprising: a casing including a first segment and a second segment detachably secured together, said segments defining an interior cavity; fastening means in said cavity to connect the wires of an electrical cord; said first segment having an end face; at least wo spaced apertures provided in said end face and communicating with a pair of channels in said cavity; a pair of semi-rigid electrically-conductive strips disposed longitudinally in said cavity, each located adjacent one of said channels and longitudinally spaced from said end face; each strip being electrically connected to one of said fastening means and adapted to frictionally contact the associated blade contact of said plug; a lock element disposed between the two said channels made of resilient, non-conductive material; said lock element having a lock means adapted to releasably lock into said opening of each said blade contact; further having an externally-operable release means to release the lock means, whereby said plug can be lockingly engaged and disengaged from the receptacle without any possibility of electric shock.

2. An electrical receptacle as defined in claim 1, wherein said end face is provided with a third aperture for a ground contact of said plug; said third aperture communicating with a third channel in said cavity; a third semi-rigid electrically-conductive strip disposed adjacent said third channel in the cavity; and connection means, to electrically connect said third strip to a ground wire from said electrical cord.

3. An electrical receptacle as defined in claim 1 , wherein said lock element comprises: a pair of wall members joined along two mutually-opposite edges by a transverse flat portion; both said wall members being of generally rectangular shape; both said wall members being located immediately inwardly of the proximate said semi-rigid strip; said lock means consisting of a protuberance formed at one end of the corners of each one of said wall members remote from said flat portion; each said protuberance extending into a respective one of said channels and adapted to releasably engage the openings in the blade contacts of said plug; said release means consisting of a pair of arm members integral with said wall members and extending in opposite directions outwardly of said casing and each terminated by an externally-operable knob, whereby pushing inwardly on both knobs releases said lock means.

4. An electrical receptacle as defined in claim 3, further including an anchoring stud projecting from the outer surface of said flat portion.

5. A duplex electrical receptacle for use with conventional electrical plugs, each having blade-type contact provided with an opening at their outer portions, comprising: a rectangular casing formed of a front segment and a rear segment and defining an inner cavity; the front face of said front segment being provided with two pairs of apertures, each adapted to receive the blade contacts of one electrical plug; forwardly extending resiliently-bendable conductive friction members, disposed rearwardly of each one of said apertures in said cavity and defining a channel for each said blade contact; connection means to electrically connect each friction member to a respective conductor connected to a power source; a lock element made of resilient non-conductive material, and disposed between pairs of contiguous channels; said lock element having a lock means adapted to releasably lock into the openings of said blade contacts; and an externally-operable release means to release the lock means, whereby said plugs can be lockingly engaged and disengaged from said receptacle without any possibility of electric shock.

6. An electrical receptacle as defined in claim 5, wherein said front face is further provided with a ground aperture for a ground blade contact for each receptacle of said duplex receptacle; each said ground aperture communicating with a channel in said inner cavity.

7. An electrical receptacle as defined in claim 5, wherein said lock element comprises two lengthwise spaced pairs of walls, each pair being joined along two mutually-opposite edges by a transverse flat portion; each said flat portion being secured to the base of said cavity; all of said walls being of generally rectangular shape, said lock means consisting of a protuberance located at the lengthwise remote front corner thereof; each protuberance projecting transversely into its respective channel and adapted to releasably engage each said opening, said release means consisting of a pair of inverted L-shape flange members, each secured at their lower corners to the lengthwise proximate outer surface corner of each one of said walls, said flange members each having an outwardly-extending forward portion; each forward portion being formed with a forwardly-projecting arm; said front segment being provided with a pair of opposite lateral openings; both arms of said flange members extending in said lateral openings and provided at their forward ends with transversely-oriented tabs; said tabs being externally operable, whereby pushing said tabs inwardly release the lock means for both said pairs of walls.

8. A duplex electrical receptacle as defined in claim 5, wherein means to indicate electrical continuity between the receptacle and a source of power, are provided

* * * * *